US006421889B1

(12) United States Patent
Chien

(10) Patent No.: US 6,421,889 B1
(45) Date of Patent: Jul. 23, 2002

(54) BUCKLE STRUCTURE

(75) Inventor: Vincent Chien, Chia Yi Hsien (TW)

(73) Assignee: Vinsonic Industrial Co., Ltd., Chia Yi Hsien (TW)

( * ) Notice: Subject to any disclaimer, the term of this patent is extended or adjusted under 35 U.S.C. 154(b) by 0 days.

(21) Appl. No.: 09/867,673

(22) Filed: May 31, 2001

(51) Int. Cl.[7] ..... A44B 11/25

(52) U.S. Cl. ..... 24/614; 24/616; 24/625; 24/633; 24/648

(58) Field of Search ..... 24/614, 625, 666, 24/633, 634, 648, 662, 616, 615; 297/482

(56) References Cited

U.S. PATENT DOCUMENTS

| | | | | | |
|---|---|---|---|---|---|
| 4,150,464 | A | * | 4/1979 | Tracy | 24/633 |
| 4,639,982 | A | * | 2/1987 | Kasai | 24/616 |
| 5,465,472 | A | * | 11/1995 | Matoba | 24/625 |
| 5,791,026 | A | * | 8/1998 | Anscher | 24/615 |
| 6,148,486 | A | * | 11/2000 | Uchara et al. | 24/614 |
| 6,263,548 | B1 | * | 7/2001 | Ikeda | 24/625 |

FOREIGN PATENT DOCUMENTS

| | | | | |
|---|---|---|---|---|
| JP | 8131215 | * | 5/1996 | 24/616 |
| JP | 8154711 | * | 6/1996 | 24/625 |
| JP | 1057114 | * | 3/1998 | 24/614 |
| JP | 1346612 | * | 12/2001 | 24/625 |

* cited by examiner

*Primary Examiner*—Victor Sakran
(74) *Attorney, Agent, or Firm*—Bacon & Thomas, PLLC

(57) ABSTRACT

A buckle structure has a male and female buckle piece. The male buckle piece has a base mount having two symmetric retaining legs extending therefrom with a guiding post disposed therebetween. Each retaining leg has an enlarged head portion having a leading angle and a retaining corner. Each retaining leg has an abutment block. In the female buckle piece is defined a hollow engagement cavity for receiving retaining legs with a guiding tunnel disposed at the center for receiving the guiding post. The female buckle piece has a side dodging opening respectively for exposing the abutment block. A stop post located in the way of each retaining leg engages with the retaining corner in buckling up; actuation of the abutment block permits the retaining corner to escape from restraint, making buckle pieces to separate easily.

1 Claim, 3 Drawing Sheets

BUCKLE STRUCTURE

BACKGROUND OF THE INVENTION

The present invention relates to a buckle structure including a male buckle piece and a female buckle piece. The male buckle piece has a base mount from which axially extends a pair of symmetric retaining legs having a guiding post disposed therebetween. Each retaining leg has an enlarged head portion with a leading angle and a retaining corner formed thereon. The outer edge of each retaining leg has a laterally extended abutment block. In the female buckle piece is defined a hollow interior for receiving the retaining legs with a guiding tunnel disposed at the center thereof for engaging with the guiding post. At the sides of the female buckle piece is disposed a dodging opening respectively for exposing the abutment block of each retaining leg. Each stop post is separably engaged with the retaining corner of each retaining leg in buckling up operation; and the inward actuation of the abutment block of each retaining leg permit the retaining corner to be free from the restraint of the respective stop post so that the male buckle piece can be easily and quickly freed from the female buckle piece.

Referring to FIG. 1, a conventional buckle structure is made up of a male buckle piece 10 and a female buckle piece 20. The male buckle piece 10 has a base portion 11 with two symmetric engagement legs 12 extending therefrom. A fork post 13 is disposed between the engagement legs 12. A rectangular slot 111 is disposed on the rear side of the base portion 11. There is a pressing face 121 defined on the outer side of each engagement leg 12. Next to the pressing face 121 is defined a retaining edge 122. Each engagement leg 12 has a slotted rear portion 123. A split 131 is defined at the center of the fork post 12. The female buckle piece 20 basically has a hollow engagement cavity 21 defined at the central portion and an insertion opening 22 defined at the rear side. A rib 23 is disposed at the center of the engagement cavity 21. On each longitudinal side of the female buckle piece 20 is disposed a locking hole 24 in communication with the engagement cavity 21. At the end of the each locking hole 24 is defined a retaining edge 25.

In assembly, as shown in FIG. 2, the engagement legs 12 and the fork post 13 of the male buckle piece 10 are inserted into the front opening 22 of the female buckle piece 20 and housed in the hollow engagement cavity 21 of the female buckle piece 20. On each side of the female buckle piece 20 is disposed the locking hole 24 for receiving the pressing face 121 of each engagement leg 12. At the rear edge of each locking 24 is provided with a retaining edge 25 so as to permit a locking edge 122 defined at the rear edge of each pressing face 121 to be in locking engagement with the retaining edge 25 as the pressing face 121 extends out of the locking hole 24. The rib 23 of the female buckle piece 20 is engaged with the split 131 of the fork post 13 of the male buckle piece 10.

Referring to FIG. 3, to get the male and female buckle pieces 10, 20 separated, the pressing faces 121 of the engagement legs 12 are forced to move inwardly so as to permit the locking edge 122 of the pressing faces 121 to be disengaged from the retaining edges 25 of the locking hole 24 of the female buckle piece 20 respectively, and the buckle pieces are pulled away from each other.

There are a couple of disadvantages associated with the conventional buckle structure given as below:

1. The pressing face 121 of the engagement leg 12 of the male buckle piece 10 is roundly curved and no guiding means is available to make the male buckle piece 10 and the female buckle piece 20 smoothly engaged with easy alignment, rendering the engagement of the male buckle piece 10 and the female buckle piece 20 relatively inconvenient and slow.
2. The disengagement of the male buckle piece 10 and the female buckle piece 20 is effected by actuation on the pressing faces 121 so as to make the engagement legs 12 of male buckle piece 10 inwardly withdrawn; such a direct pressing on the engagement legs requires more effort, making the separation of the male buckle piece 10 and the female buckle piece 20 relatively difficult.

SUMMARY OF THE INVENTION

Therefore, the primary object of the present invention is to provide an improved buckle structure wherein the front end of each retaining leg of the male buckle piece is provided with a leading angle so as to make the male and female buckle pieces be engaged with each other with precise alignment by way of the guidance of the guiding post and guiding groove. Thereby easy alignment can effectively prevent the retaining legs from astray shift in engagement, making the engagement of the male buckle piece and female buckle piece in an easy, speedy and convenient manner.

Another object of the present invention is to provide an improved buckle structure wherein the male buckle piece and female buckle piece are separated by pressing an abutment block instead of directly forcing retaining legs. The pressing on the abutment block can produce a leverage effect on the retaining legs so that only small force is required to make the retaining legs separated, rendering easy and quick separation of the male and female buckles.

DETAILED DESCRIPTION OF THE PREFERRED EMBODIMENT

Figure 1:
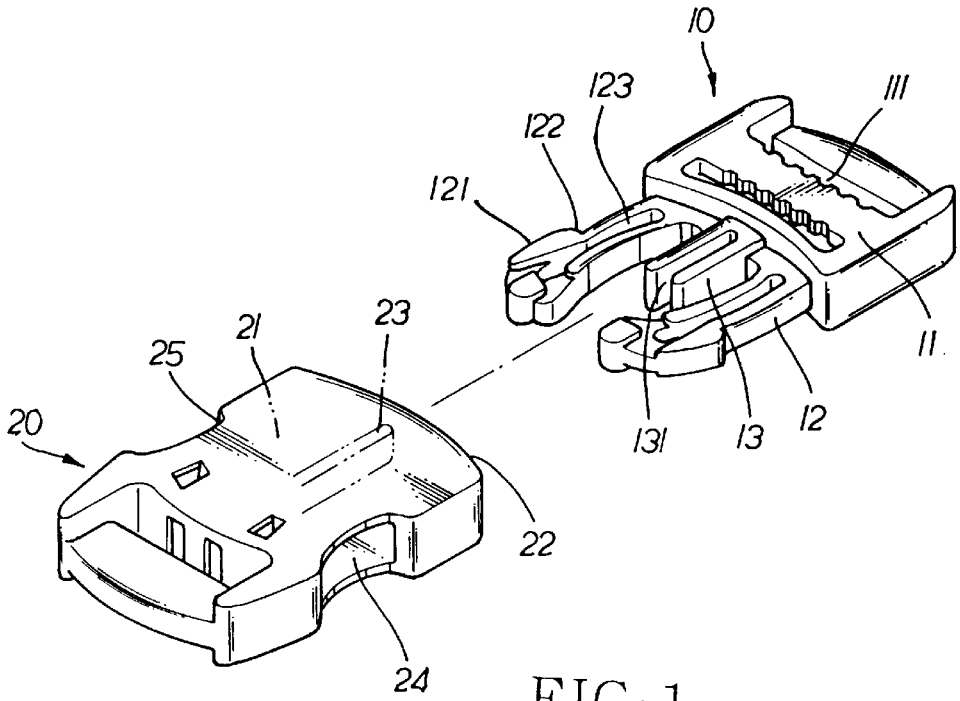
FIG·1 PRIOR ART
FIG. 1 is a perspective diagram showing the exploded components of a conventional buckle.
Figure 2:
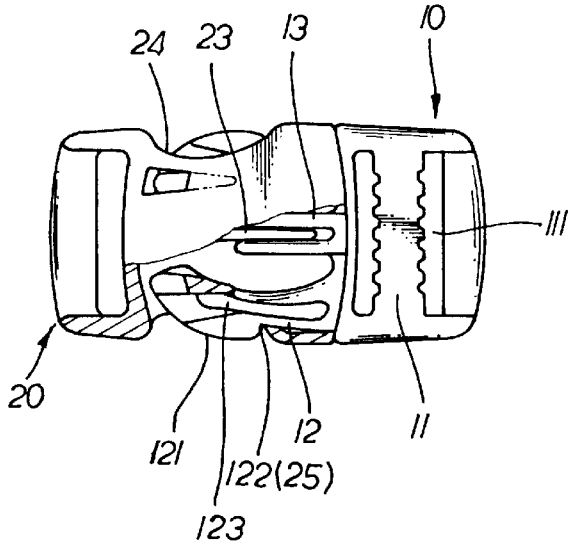
FIG·2 PRIOR ART
FIG. 2 is a diagram showing the assembly and partial section of the conventional buckle.
Figure 3:
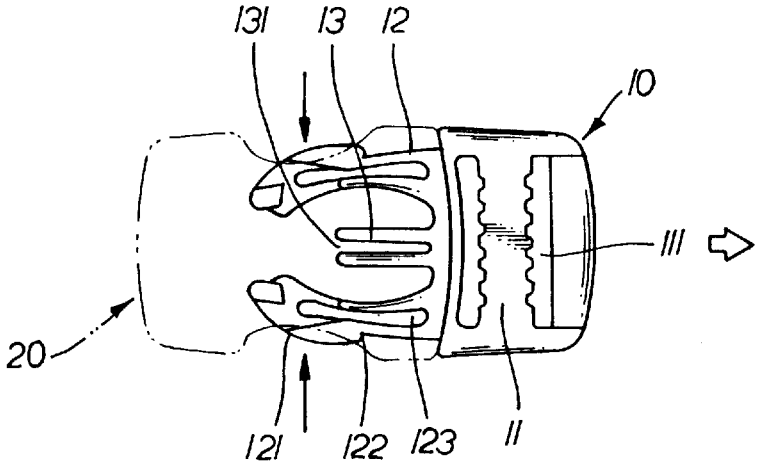
FIG·3 PRIOR ART
FIG. 3 is a diagram showing a pressing operation on the conventional buckle.
Figure 4:
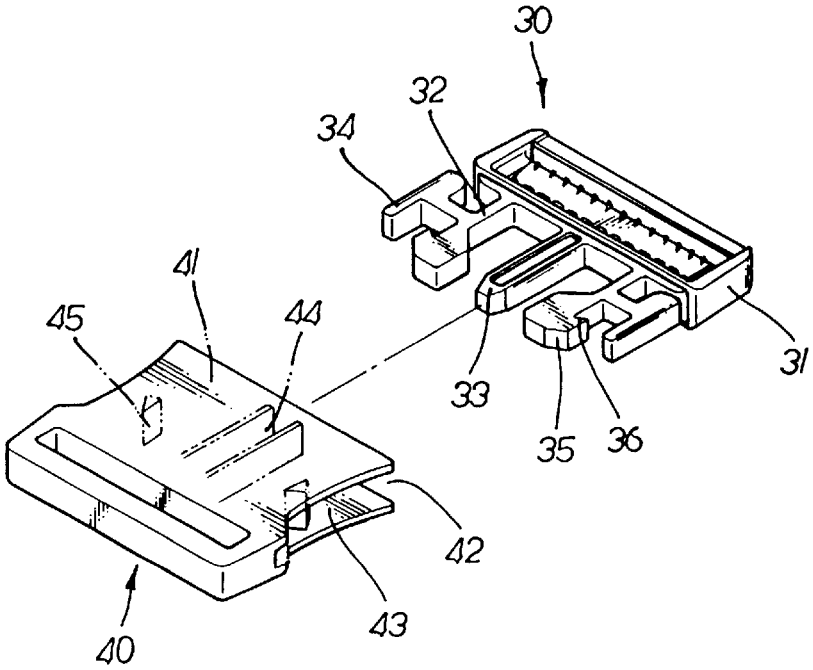
FIG. 4 is a perspective diagram showing the exploded components of the present invention.

Referring to FIG. 4, the improved buckle of the present invention is comprised of a male buckle piece 30, a female buckle piece 40. The male buckle piece 30 has a base mount 31 from which extend two symmetric retaining legs 32 with a guiding post 33 disposed between the retaining legs 32. Each retaining leg 32 has a T-shaped abutment block 34 extends laterally from the outer edge thereof. Each T-shaped abutment block 34 has a front end of thinner thickness than the rear end. Each retaining leg 32 has an enlarged head portion slightly exceeding over the front end of the abutment block 34. Each enlarged head portion has a leading angle 35 and a retaining corner 36. The female buckle piece 40 has a partially hollow interior, including the engraved right and left side cavities 41, the front insertion opening 42 and the side dodging openings 43. At the central position of the engraved right and left side cavities 41 is disposed a pair of spaced parallel walls to form a guiding tunnel 44. Between the guiding tunnel 44 and each side dodging opening 43 is disposed a stop post 45 having a triangular cross section.

Figure 5:
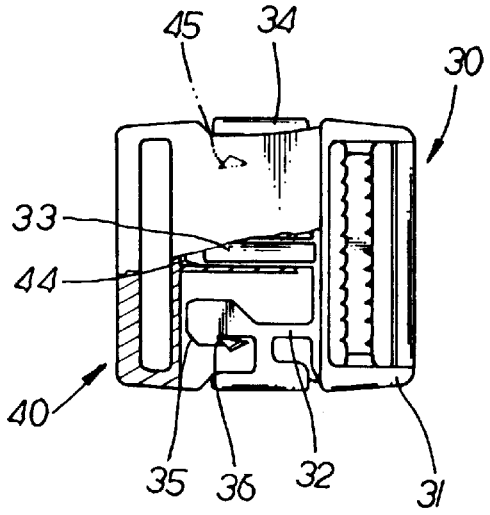
FIG. 5 is a diagram showing the assembly and partial section of the buckle of the present invention.

In buckling up operation, referring to FIG. 5, the retaining legs 32 and the guiding post 33 of the male buckle piece 30 are inserted into the front insertion opening 42 of the female buckle piece 40 and further into right and left hollow side cavities 41. The side dodging openings 43 and the central guiding tunnel 44 of the female buckle piece 40 with which is engaged the guiding post 33 permit the male buckle piece 30 to be in quick and precise alignment and engagement with female buckle piece 40 without shifting astray. Further pushing the male buckle piece 30 into the female buckle piece 40 will cause the enlarged head portion of the retaining legs 32 with the leading angles 35 moving against the stop posts 45 to be flexibly inwardly bent until the enlarged head portion passes the stop posts 45, the retaining legs 32 will resiliently resume to its normal positions. At then, as a result, each retaining corner 36 of the enlarge head portion of the retaining leg 32 will come into locking engagement with the stop post 45 respectively. According, the male buckle piece 30 will not disengage with the female buckle piece 40.

Figure 6:
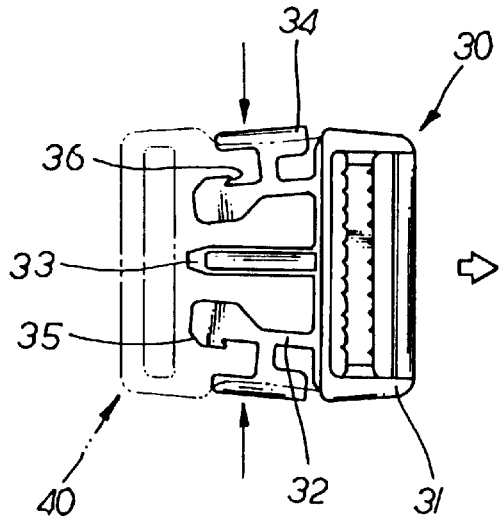
FIG. 6 is a diagram showing a pressing operation on the buckle thereof.

As shown in FIG. 6, to get the male buckle piece 30 and the female buckle piece 40 separated, the abutment blocks 34 exposed out of the dodging openings 43 of the female buckle piece 40 are forced to move inwardly so as to make the retaining legs 32 bent inwardly, causing the retaining corners 36 of the retaining legs 32 to disengage from stop posts 45. Then the male buckle piece 30 can be pulled out of engagement with the female buckle piece 40.

It can be obviously seen the buckle structure of the present invention has the following advantages:

1. The leading angle 35 of each retaining leg 32 of the male buckle piece 30 along with the guiding post 33 and restraint tunnel 44 can help the male buckle piece 30 and the female buckle piece 40 align easily in buckling engagement without shift astray, making the buckling up ready and speedy.
2. The separation of the male buckle piece 30 and female buckle piece 40 is effected not by direct pressing the retaining legs 32, but pressing on the extended abutment blocks 34 on the retaining legs 32 can produce leverage effect; so, the male buckle piece 30 and female buckle piece 40 can be separated with little effort.

I claim:

1. A buckle structure comprising a male buckle piece and a female buckle piece; said male buckle piece having a base mount from which are extended a pair of symmetric retaining legs; said female buckle piece having an insertion hollow engagement cavity and an insertion opening; wherein it is characterized by that:

said retaining legs of said male buckle piece has a guiding post defined therebetween, at a center of each said retaining leg laterally extends a T-shaped abutment block which has an enlarged head portion having a leading angle defined at a front end and a retaining corner at a rear end thereof; said T-shaped abutment blocks can produce leverage effect on said retaining legs when pushed inwardly, permitting said retaining legs to be easily operated;

said female buckle piece has a dodging opening at each side thereof for exposing said T-shaped abutment block of said retaining leg; in said insertion opening of said female buckle piece are disposed a pair of parallel walls to form a guiding tunnel; between said guiding tunnel and each said dodging opening is disposed a vertical stop post which can separately engaged with said retaining corner of said T-shaped enlarged head portion;

whereby said retaining legs of said male buckle piece are inserted into said insertion opening and further into said hollow engagement cavity of said female buckle piece with said guiding post in precise alignment and engagement with said guiding tunnel so as to prevent said male buckle piece from shifting astray; as said retaining corner of each retaining leg comes into engagement with said stop post, said male buckle piece and said female buckle piece are securely locked together without easy separation.

* * * * *